United States Patent [19]

Diemer

[11] Patent Number: 4,530,821

[45] Date of Patent: Jul. 23, 1985

[54] BRIDGING OPERATIONAL SHUT-DOWNS OF THE AMMONIA WASHER OF A PLANT OPERATING ACCORDING TO THE SEMI-DIRECT TECHNIQUE FOR THE REMOVAL OF AMMONIA FROM COKING OVEN GAS

[75] Inventor: Peter Diemer, Essen, Fed. Rep. of Germany

[73] Assignee: Krupp-Koppers GmbH, Essen, Fed. Rep. of Germany

[21] Appl. No.: 531,595

[22] Filed: Sep. 12, 1983

[30] Foreign Application Priority Data

Nov. 23, 1982 [DE] Fed. Rep. of Germany ..... 3243188

[51] Int. Cl.[3] ..... B01D 53/34

[52] U.S. Cl. ..... 423/238; 55/70; 423/357; 423/550

[58] Field of Search ..... 423/237, 238, 550, 357, 423/220; 55/70

[56] References Cited

U.S. PATENT DOCUMENTS 1,315,639 9/1919 Piette ..... 423/550

3,556,721 1/1971 Radusch ..... 423/238

*Primary Examiner*—Earl C. Thomas

*Assistant Examiner*—Jeffrey E. Russel

*Attorney, Agent, or Firm*—Michael J. Striker

[57] ABSTRACT

A process and system are disclosed for the bridging of operational standstills of an ammonia washer of a plant operating according to the semi-direct technique for the removal of ammonia from coking oven gas. During the operational standstills of the ammonia washer, the ammonia is washed out from the coking oven gas in a secondary cooler constituting three parts, an upper part (Wash Stage I) provided with stripped water from an ammonia still, a middle part (wash stage II) provided with gas water, and a lower part (wash stage III) provided with circulation water. All of the waters provided for the secondary cooler are collected in its sump, and after a separation of the circulation water necessary for the Wash Stage III, it is split into two partial streams, one serving for the recovery of stripped water for Wash Stage I and which is led into an ammonia still provided only with water vapor and the other partial stream is led into an ammonia still provided with water vapor and alkali. Also disclosed is a system containing a secondary cooler defining three vertically disposed sections of metal mesh beds.

7 Claims, 2 Drawing Figures

BRIDGING OPERATIONAL SHUT-DOWNS OF THE AMMONIA WASHER OF A PLANT OPERATING ACCORDING TO THE SEMI-DIRECT TECHNIQUE FOR THE REMOVAL OF AMMONIA FROM COKING OVEN GAS

BACKGROUND OF THE INVENTION

The invention concerns a method for the bridging of operational shut-downs of an ammonia washer of a plant operating according to the semi-direct technique for the removal of ammonia from coking oven gas. The coking oven gas, in connection with the ammonia wash, is subjected to a direct secondary cooling and the ammonia contained in the process water is freed by means of driving off with water vapor (steam) and the addition of alkali.

Various methods are known for the removal of ammonia from the coking oven gas. According to the so-called direct technique, the previously de-tarred gas is led directly into a saturator loaded with an acid, preferably sulfuric acid. The ammonia present in the gas is reacted in the saturator so as to form salt. In practice, however, the direct technique has not previously been capable of being accomplished.

In contrast, with the so-called semi-direct technique, the coking oven gas is initialy cooled in a precooling stage to temperatures from 20 up to 30 degrees C., whereby already part of the ammonia present in the gas is separated out together with the gas water (gas condensate). Thereafter, the pre-cooled and de-tarred coking oven gas is first led into an apparatus likewise loaded with an acid, for removal of the residual ammonia. In the text which follows, this apparatus of interest is always designated as an ammonia wash, for purposes of providing a uniform nomenclature. It is, however, clear to the skilled man of the art that this apparatus can display different construction features, and is frequently also designated in practice as a saturator. The so-called ammonia washer is loaded with sulfuric acid or phosphoric acid so as to provide for the formation of the corresponding ammonium salt. However, this reaction, in which heat is released, leads to increase in temperatures of the oven gas and also to increase in its vapor dew point. Therefore gas must still be subjected to a so-called secondary cooling in connection with the ammonia wash. This secondary cooling can, for example, be performed directly, whereby the coking oven gas is sprayed in one or more stages directly with cooling water led in circulation. Herewith, the accumulating excess circulation water is, in normal manner, treated together with the gas water, which is obtained upon the pre-cooling of the coking oven gas, in an ammonia still. Thereby the free ammonia, by means of the addition of water vapor, and the bound ammonia, by means of addition of alkali, e.g. caustic soda or milk of lime, are liberated; and thereupon subsequently added to the coking oven gas before the ammonia wash. The stripped water running out from the ammonia still is expelled from the process after an appropriate waste water treatment. Compared to the direct techniques mentioned above, the semi-direct techniques have been performed well in practice.

It so happens that the ammonia washer for the removal of ammonia according to the semi-direct technique must occasionally go out of use for purposes of routine maintenance and servicing or for other reasons. In such cases when this happens, the arrangements for the production of the coking oven gas are not cut out of action and, based on the criterion of coking oven gas purity, one can also not avoid having to remove the ammonia from the gas. Accordingly, such operational standstills of the ammonia washer have previously only been bridged by provision of a reserve unit, which upon coming out of line of the normal ammonia washer takes over its function. Obviously, such a reserve unit increases the plant and maintenance costs to a not inconsiderable extent. Moreover, an additional consideration is that the reserve unit is required only during relatively brief "off-line" periods, and is indeed unprofitable from this point of view.

SUMMARY OF THE INVENTION

The invention is therefore based upon the object of providing a method for the bridging of operational standstills of the ammonia washer operating according to the semi-direct technique with which the provision of a reserve unit can be avoided and, instead of this, a substantially simpler and more cost-favorable solution of the problem is made possible.

The method of the above mentioned type serving for the attainment of this object is characterized according to the present invention in that during the operational standstills of the ammonia washer the ammonia is washed in the secondary cooler, whereby the upper part (Washing Stage I) of the secondary cooler is provided with stripped water from the ammonia still, the middle part (Wash Stage II) is provided with a gas water and the lower part (Wash Stage III) is provided with cooled circulation water, and all of the water provided to the secondary cooler is collected in the sump thereof; the ammonia is divided into two partial streams, of which the first partial stream, serving for recovery of the stripped water for Wash Stage I is led into an ammonia still loaded only with water vapor, whereas the second partial stream is led into an ammonia still provided with water vapor and alkali.

This means that the method according to the present invention solves the lingering problem by having the direct secondary cooler take over the function of the ammonia wash during the operational standstill. Herewith, it is naturally a prerequisite that the possibility is present for a liquid delivery on three levels (upper part, middle part and lower part). In practice, one can usually proceed with a normal direct secondary cooler. Should this however not be the situation in exceptional cases, then the secondary cooler must be modified or changed over in the first instance so as to be approriate for the performance of the method according to the present invention. Even when this is required, the process is nevertheless less expensive than having to provide a second ammonia washer serving as reserve unit.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

In each of these flow schemes only those apparatus parts and arrangements unconditionally necessary for illustration of the method according to the present invention have been represented, whereas such additional arrangements as measuring and regulating devices, pumps and the like as well as the arrangement needed both before and after for purposes of coking oven gas generation and treatment have not been represented. The valves laid out in black in the flow schemes are always closed.

DETAILED DESCRIPTION OF THE PREFERRED EMBODIMENTS

Figure 1:
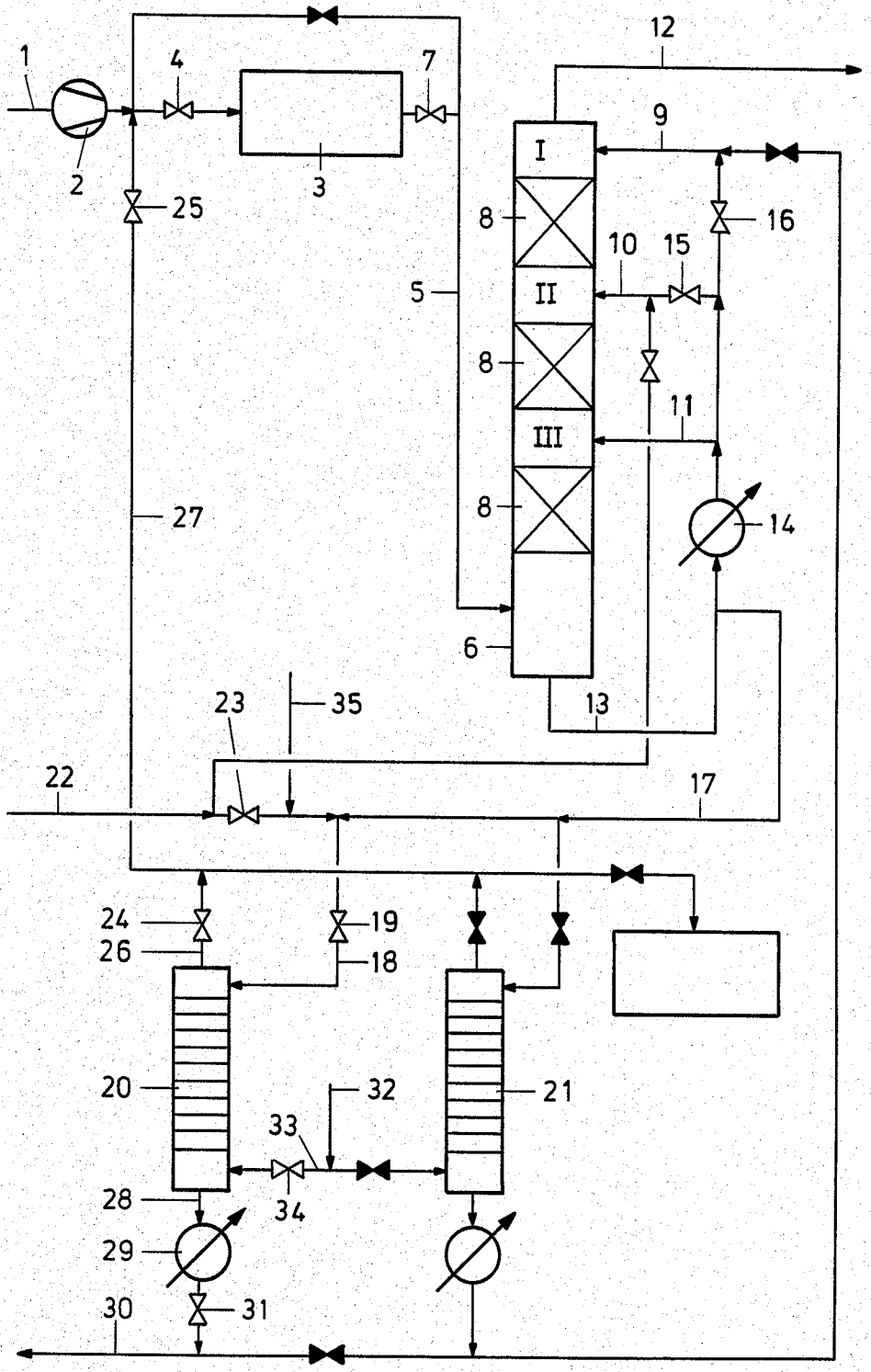
FIG. 1 is a flow scheme representation for the normal operation of a plant for the removal of ammonia from coking oven gas, when the ammonia wash is running, i.e. "on-line".

Following the flow scheme of FIG. 1, it can be seen that the coking oven gas coming from the pre-cooling is led across conduit 1 and the gas exhauster 2, i.e. suction apparatus or aspirator, into the ammonia washer 3. Valve 4 is open at this point. The coking oven gas has a temperature between about 40 and 50 degrees C. and an ammonia content between about 5 and 10 $g/m_n^3$ upon entry into the ammonia wash 3. The ammonia washer 3 is coated with sulfuric acid or aqueous phosphoric acid solution, whereby the ammonia contained in the gas reacts under corresponding formation of salt. As a result of this reaction, the gas temperature is increased to about 45–55 degrees C., whereafter the coking oven gas must be led across conduit 5 from below into the secondary cooler 6. While this is happening the valve 7 is opened. The secondary cooler is provided with three superposed metal mesh beds 8. Above each metal mesh bed is provided a spreading or distribution arrangement (not more closely illustrated in the drawing), by means of which the water necessary for the direct gas cooling is provided to the metal mesh beds. The delivery of the water follows across conduits 9, 10, and 11, whereas the cooled coking oven gas leaves the secondary cooler 6 across conduit 12 and is introduced into after-connected arrangements for gas treatment with a temperature from about 20–30 degrees C. and ammonia content from about 0.01–0.1 $g/m_n^3$. The water provided to the various levels of the secondary cooler is collected in its sump and discharged across conduit 13. The necessary re-cooling of the water takes place in cooler 14, to a temperature from about 20 to about 30 degrees C. before the water is again delivered into the secondary cooler 6 across conduits 9, 10, and 11 and valves 15 and 16, in circulation. The excess circulation water, which has separated in the secondary cooler as a result of the lowering of the dew point of the coking oven gas, is branched off from the water stream in conduit 13 and led across conduits 17 and 18 to the ammonia still 20 provided with installations as bottoms or trays. While this is happening, the valve 19 is opened. In addition, so-called gas water (gas condensate), which arises from the cool moisture and the water formed during the coking of the coal, and during the pre-cooling has been discharged from the crude coking oven gas, is provided into this ammonia still 20. This gas water, having an ammonia content lying between about 3 and 6 $g/dm^3$, is introduced into the ammonia still 20 across conduit 22, which flows into conduit 18. In the ammonia still 20, the ammonia is driven out from the introduced water by means of the addition of alkali, e.g. caustic soda or milk of lime, and the supply of water vapor. The ammonia driven out escapes across the top from ammonia still 20 and, with opened valves 24 and 25, added across conduits 26 and 27 to the coking oven gas before the ammonia washer 3. The stripped, i.e. freed of ammonia, water is discharged across conduit 28 from the sump of the ammonia still 20 and is led after appropriate cooling in cooler 29 into conduit 30 from which it is discharged into a waste water purification plant not represented in FIG. 1. While this is happening valve 31 is opened. The necessary supply of water vapor (steam) for the ammonia still 20 is effected across conduits 32 and 33 with opened valve 34. The alkali addition takes place across conduit 35, whereby the added alkali is led across conduits 22 and 18 into the upper part of the ammonia still 20. Based upon a desire to provide absolute operational dependability for the waste water purification plant, a further ammonia still 21 is provided in addition to the ammonia still 20, as a reserve unit, so that in case of need the operation can be switched at any time from the one to the other amomnia still.

The apparatus parts not provided with numerical designation in FIG. 1 are not necessary for illustration of the normal operation during which the ammonia washer 3 is in action. These will, however, be more closely considered in the discussion of FIG. 2.

Figure 2:
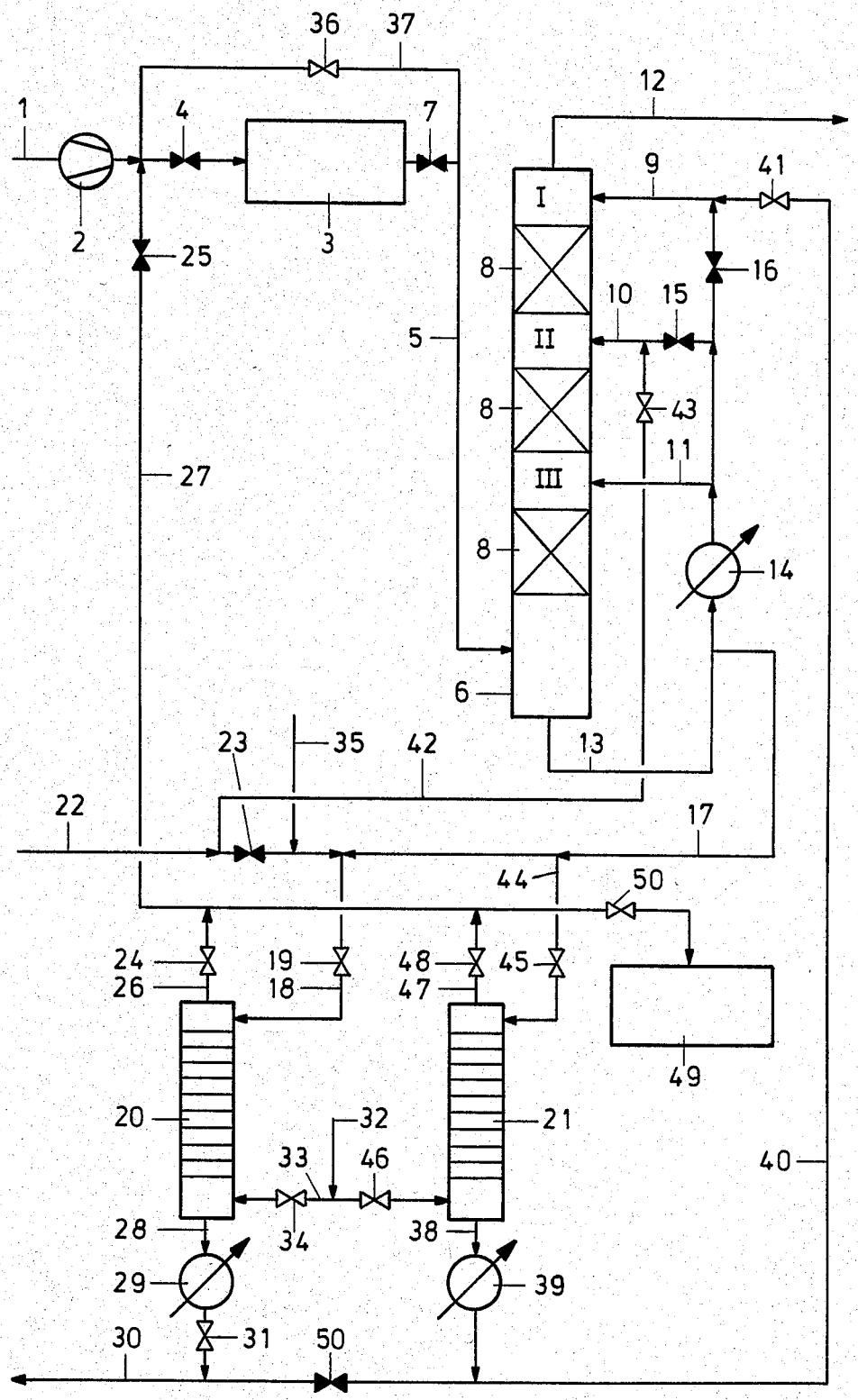
FIG. 2 is a flow scheme representation for the situation when the ammonia wash is out of operation, and accordingly, the removal of ammonia follows in the secondary cooler.

FIG. 2 serves the purpose of illustrating the method according to the present invention for the situation when the ammonia washer is out of operation. The flow schemes in FIGS. 1 and 2 correspond and coinciding numerical designations naturally also have the same meaning. When the ammonia washer 3 must be brought out of operation, the valves 4 and 7 are closed. Simultaneously, valve 36 is opened. The coking oven gas is then led behind the gas exhauster 2 into the by-passing line 37, which runs into conduit 5 leading into the secondary cooler 6. The secondary cooler 6 now serves for the washing out of the ammonia present in the gas. For this purpose its upper part (wash stage I) is provided with stripped water across conduit 9 which arises from the ammonia still 21. This stripped water is discharged from the sump of the ammonia still 21 across conduit 38 and is led into conduit 40 which leads to conduit 9 after passing through the cooler 39 in which it undergoes a cooling down to about 20–30 degrees C. While this is happening, valve 31 is opened. In this case, the so-called gas water is delivered from conduit 22 to the middle part of secondary cooler 6 (Wash Stage II). For this purpose conduit 42, which leads into conduit 10, branches off from conduit 22 before the valve 23. The valves 23 and 15 are herewith closed whereas the valve 43 is opened. The bottom of the secondary cooler 6 (Wash Stage III) is provided as before with cooled circulation water. Thus, the course of circulation across conduits 13 and 11, as well as cooler 14, corresponds to the manner of operation as described in connection with FIG. 1. The Wash Stage III mainly serves the purpose of removing from the coking oven gas the condensation heat which was provided into the gas by means of the prior-connected gas exhauster 2. Corresponding to the manner of operation according to FIG. 1, here also, all of the water delivered to secondary cooler 6 is collected together in the sump thereof, and it initially discharged therefrom across conduit 13. Since the valves 15 and 16 are closed in this case, only a partial stream of the waters discharged across conduit 13 can be initially branched off. This partial stream is to be delivered again to the bottom part of secondary cooler 6 (Wash Stage III) as circulation water across cooler 14 and conduit 11. The remaining amounts of water from conduit 13 are led across conduit 17 to the ammonia stills 20 and 21. In connection therewith, this amount of water is once more split into two partial streams, whereby the ammonia still 21 is charged with that partial stream which is necessary for the recovery of the stripped water for Wash Stage I. For this purpose, this partial stream is branched off from conduit 17 and is led across conduit 44 and open valve 45 to the upper part of the ammonia still 21 provided with installations as bottoms or trays. This still is only loaded with water vapor from conduit 32, whereby in this case the valve 46 and conduit 33 is open. The stripped water is discharged across conduit 38 from the sump of the ammonia still 21 and led across cooler 39 conduit 40 and valve 41 for re-delivery to the secondary cooler 6. The ammonia driven off escapes across the top from the ammonia still 21 and is led with opened valve 48 across the conduit 47 into conduit 27. In this case it is not, however, possible to add the driven-off ammonia into the coking oven gas before the ammonia washer 3. Accordingly, the valve 25 remains closed. In the event that some other possibility for employment of this driven-off ammonia presents itself, it is naturally valuable to employ the same. When this, however, is not the case it must be introduced to an ammonia destruction 49. When this takes place, the valve 50 is open. The ammonia destruction 49 can be operated as a combustion or a catalytic decomposition plant. The partial stream of sump product from secondary cooler 6, still to be worked up and remaining in conduit 17, after a discharge of the partial stream across conduit 44, is delivered across conduit 18 to the ammonia still 20. While this is taking place, the valve 19 is naturally opened. In this still, in addition to steam from conduit 32, and 33, alkali is directed from conduit 35, so that the manner of operation corresponds to the manner of operation already described further above in connection with FIG. 1. The stripped water is discharged across conduit 28 and led across cooler 29 as well as conduit 30 to the not-represented waste water purification plant. The valve 50 and conduit 30 are closed at this time. The ammonia driven off in ammonia still 20 is similarly introduced to the ammonia destruction 49, across conduits 26 and 27. The coking oven gas, freed of ammonia, leaves the secondary cooler 6 across conduit 12 with a temperature of about 20–30 degrees C. This gas still displays a maximum ammonia content of 0.1 $g/m_n^3$ of the waters discharged across conduit 13 from the secondary cooler 6, as a rule between 50 and 70% by volume are delivered again across conduit 11 as circulation water to the washer stage 3, whereas 15 and 25% by volume is led across conduit 44 into the ammonia still 21 and after the driving-off ammonia is re-employed as stripped water for the Wash Stage I. The remainder of the waters discharged from the secondary cooler 6 is led into the ammonia still 20 and is expelled from the process after the ammonia still as described above.

The cost advantage obtainable by means of the doing away with a second ammonia wash according to the present invention can run to DM2,000,000 with a coking oven gas treatment plant having a throughput of 70,000 $m_n^3/h$. The entire plant parts represented in the flow schemes display construction customary in the coking art.

It will be understood that each of the elements described above, or two or more together, may also find a useful application in other types of ammonia removals differing from the types described above.

While the invention has been illustrated and described as embodied in a ammonia removals, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. In the removal of ammonia from coking oven gas by means of an ammonia washer of a plant operating according to the semi-direct technique, of the type wherein the coking oven gas, in connection with the ammonia washer, is subjected to a direct secondary cooling and the ammonia contained in the process waters is freed by means of driving-off with water vapor under the addition of alkali, a process for bridging operational standstills of said ammonia washer comprising washing out said ammonia in a secondary cooler during said operational standstills of said ammonia washer, an upper part, Wash-Stage I, of said secondary cooler being provided with stripped water from an ammonia still, a middle part, Wash Stage II, of said secondary cooler being provided with gas water and a lower part, Wash Stage III, of said secondary cooler being provided with cooled circulation water.

2. The process according to claim 1, further comprising collecting all of said waters provided to said secondary cooler in a sump of said secondary cooler.

3. The process according to claim 1, further comprising after separation of circulation water necessary for said wash stage III, dividing the circulation water into two partial streams, of which a first partial stream is led for recovery of said stripped water for said wash stage I into an ammonia still provided only with water vapor and a second partial stream is led into an ammonia still provided with water vapor and alkali.

4. Process according to claim 1, wherein said washing out of ammonia in said secondary cooler is performed at temperatures between 20 and 30 degrees C.

5. Process according to claim 2, wherein of said waters collected in said sump of said secondary cooler between about 50 and 70% by volume are used as circulation water for said Wash Stage III and between about 15 and 25% by volume are used as stripped wash water for said wash stage I.

6. Process according to claim 3, wherein ammonia vapors are obtained from said ammonia stills and said ammonia vapors are subjected to a common further processing.

7. Process according to claim 3, wherein ammonia vapors are obtained from said ammonia stills and said ammonia vapors are subjected to destruction.

* * * * *